US006203889B1

(12) United States Patent
Quincy, III et al.

(10) Patent No.: US 6,203,889 B1
(45) Date of Patent: Mar. 20, 2001

(54) NONWOVEN WEBS HAVING ZONED MIGRATION OF INTERNAL ADDITIVES

(75) Inventors: Roger Bradshaw Quincy, III, Cumming; Ali Yahiaoui, Roswell; Jeffrey Lawrence McManus, Canton, all of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/126,502

(22) Filed: Jul. 30, 1998

(51) Int. Cl.[7] ..... B32B 3/00; B32B 5/02; B32B 27/04; D04H 13/00

(52) U.S. Cl. ..... 428/195; 428/196; 442/59; 442/64; 442/71; 442/361

(58) Field of Search ..... 442/59, 181, 70, 442/71, 361, 64; 428/195, 196

(56) References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,502,538 | 3/1970 | Petersen | 161/150 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,849,241 | 11/1974 | Butin et al. | 161/169 |
| 4,340,563 | 7/1982 | Appel et al. | 264/518 |
| 4,567,796 | 2/1986 | Kloehn et al. | 83/53 |
| 4,857,251 | 8/1989 | Nohr et al. | 264/103 |
| 4,920,168 | 4/1990 | Nohr et al. | 524/188 |
| 4,923,914 | 5/1990 | Nohr et al. | 524/99 |
| 5,025,052 | 6/1991 | Crater et al. | 524/104 |
| 5,108,820 | 4/1992 | Kaneko et al. | 428/198 |
| 5,108,827 | 4/1992 | Gessner | 428/219 |
| 5,120,888 | 6/1992 | Nohr et al. | 524/99 |
| 5,178,931 * | 1/1993 | Perkins et al. | 428/198 |
| 5,336,552 | 8/1994 | Strack et al. | 428/224 |
| 5,382,400 | 1/1995 | Pike et al. | 264/168 |
| 5,459,188 | 10/1995 | Sargent et al. | 524/319 |
| 5,482,765 * | 1/1996 | Bradley et al. | 428/286 |
| 5,667,562 | 9/1997 | Midkiff | 96/15 |
| 5,681,963 | 10/1997 | Liss | 548/455 |
| 5,687,916 | 11/1997 | Romano, III et al. | 241/1 |
| 5,688,157 | 11/1997 | Bradley et al. | 442/340 |
| 5,707,468 | 1/1998 | Arnold et al. | 156/626 |
| 5,709,921 | 1/1998 | Shawver | 428/152 |
| 5,770,531 | 6/1998 | Sudduth et al. | 442/361 |

FOREIGN PATENT DOCUMENTS

| | | | |
|---|---|---|---|
| WO 97/22576 | 12/1996 | (WO) | C07C/69/63 |

OTHER PUBLICATIONS

U.S. application No. 08/877,377, Marmon et al., filed Jun. 1998.

Manson, John A. and Sperling, Leslie H.: *Polymer Blends and Composites,* Plenum Press, New York, ISBN 0–306–30831–2, pp. 273–277 (1976).

* cited by examiner

*Primary Examiner*—Terrel Morris
*Assistant Examiner*—Christopher C. Pratt
(74) *Attorney, Agent, or Firm*—Pauley Petersen Kinne & Fejer

(57) ABSTRACT

Nonwoven webs prepared from a blend of polymer and a migrating internal additive are heat treated only in selected regions to cause surface migration of the additive in those regions. The nonwoven webs have a desired property attributed to the additive in the selective regions. Regions surrounding the selected regions are not heat treated, and are either devoid of the desired property, or manifest the property to a lesser extent than in the heat treated regions.

28 Claims, 2 Drawing Sheets

NONWOVEN WEBS HAVING ZONED MIGRATION OF INTERNAL ADDITIVES

FIELD OF THE INVENTION

This invention is directed to nonwoven webs having selective, zoned migration of internal additives to create properties affecting only selected regions of the nonwoven web.

BACKGROUND OF THE INVENTION

Hot air knives have been employed for increasing the integrity of nonwoven webs such as spunbonded filament webs. A hot air knife is useful in bonding the individual polymer filaments together at various locations, so that the web has increased strength and structural integrity. Hot air knives are also used for aligning meltblown fibers during manufacture of meltblown webs, for cutting nonwoven fabrics, for chopping reclaim, and for a variety of other uses.

One use of the hot air knife is to improve the structural integrity of nonwoven webs before passing them through standard inter-filament bonding processes. Through-air bonding ("TAB") is a process of bonding a nonwoven bicomponent fiber web in which air sufficiently hot to melt one of the polymers in the fibers of the web is forced through the web. The air velocity is between 100 and 500 feet per minute and the dwell time may be as long as 6 seconds. The melting and resolidification of the polymer provides the bonding.

A conventional hot air knife includes a mandrel with a slot that blows a jet of hot air onto the nonwoven web surface. U.S. Pat. No. 4,567,796, issued to Kloehn et al., discloses a hot air knife which follows a programmed path to cut out shapes needed for particular purposes, such as the leg holes in disposable diapers. U.S. Pat. No. 5,707,468, issued to Arnold et al., discloses using a hot air knife to increase the integrity of a spunbond web. U.S. application Ser. No. 08/877,377 to Marmon et al., filed Jun. 17, 1998, discloses a zoned hot air knife assembly used to heat discrete portions of a nonwoven web.

It is also known to use heat to facilitate the uniform migration of internal additives from nonwoven webs. U.S. Pat. Nos. 4,857,251, 4,920,168, 4,923,914, and 5,120,888, all issued to Nohr et al., disclose using heat to facilitate the migration of internal additives to the surfaces of nonwoven webs.

SUMMARY OF THE INVENTION

The present invention is directed to nonwoven webs initially having a substantially homogeneous distribution of internal additives. The internal additives are caused to migrate to the surface only in selected regions or "zones" of the nonwoven web, causing the nonwoven web to have desired or enhanced properties only in the selected zones. The selected migration of internal additives can be in the X, Y and/or Z directions, and can cause the nonwoven web to have differential properties in any direction. The invention also includes a method of making a nonwoven web having differential properties in one or more directions, caused by the selected migration of internal additives.

DEFINITIONS

Figure 1:
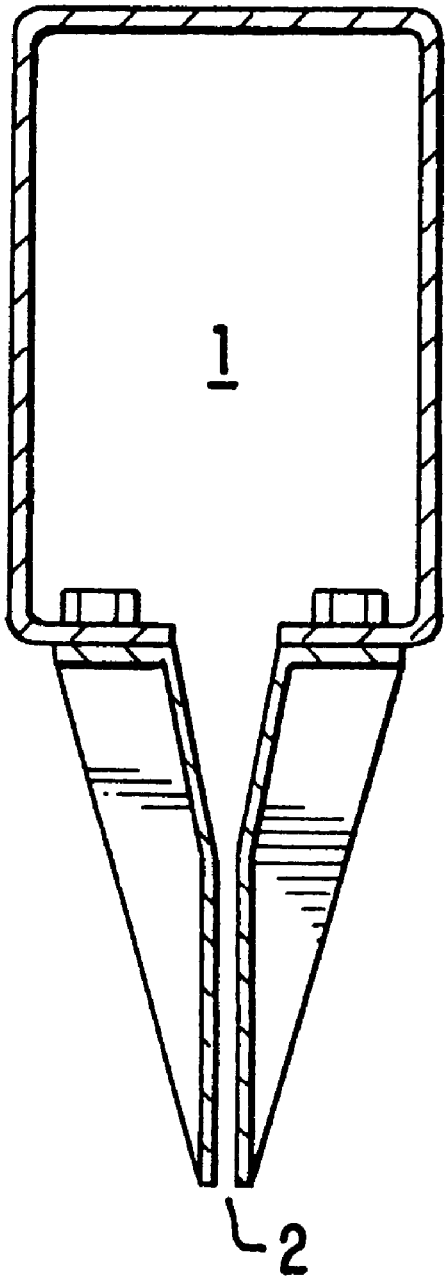
FIG. 1 is a sectional view of a conventional hot air knife, used to supply hot air to a nonwoven web.

As used herein, the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The term also includes films that have been perforated or otherwise treated to allow air to pass through. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91.)

As used herein, the term "microfibers" means small diameter fibers having an average diameter not greater than about 75 microns, for example, having an average diameter of from about 0.5 micron to about 50 microns, or more particularly, microfibers may have an average diameter of from about 2 microns to about 40 microns.

As used herein, the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Petersen, and U.S. Pat. No. 3,542,615 to Dobo et al. Spunbond fibers are quenched and generally not tacky on the surface when they enter the draw unit, or when they are deposited onto a collecting surface. Spunbond fibers are generally continuous and have average diameters larger than 7 microns, often between about 10 and 20 microns.

As used herein, the term "spunbonded web" refers to a nonwoven mat comprised of spunbonded fibers.

As used herein, the term "meltblown fibers" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin. Meltblown fibers are microfibers which may be continuous or discontinuous, are generally smaller than 10 microns in diameter, and are generally self bonding when deposited onto a collecting surface.

As used herein, the term "meltblown fabric" refers to a nonwoven mat being comprised of meltblown fibers.

As used herein, the term "polymer" generally includes but is not limited to, homopolymers, copolymers, such as for example, block, graft, random and alternating copolymers, terpolymers, etc., and blends and modifications thereof. Furthermore, unless otherwise specifically limited, the term "polymer" shall include all possible geometrical configurations of the material. These configurations include, but are not limited to isotactic, syndiotactic and atactic symmetries.

As used herein, the term "machine direction" or MD means the length of a fabric in the direction in which it is produced. The term "cross machine direction" or CD means the width of fabric, i.e., a direction generally perpendicular to the MD.

As used herein, the term "bicomponent" refers to fibers which have been formed from at least two polymers extruded from separate extruders but spun together to form one fiber. Bicomponent fibers are also sometimes referred to as multicomponent or conjugate fibers. The polymers are usually different from each other though bicomponent fibers may be made from fibers of the same polymer. The polymers are arranged in substantially constantly positioned distinct zones across the cross-section of the bicomponent fibers and extend continuously along the length of the conjugate fibers. The configuration of such a bicomponent fiber may be, for example, a sheath/core arrangement wherein one polymer is surrounded by another or may be a side-by-side arrangement or an "islands-in-the-sea" arrangement. Bicomponent fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios.

As used herein, the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber; instead they usually form fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein, the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, the term "hot air knife" refers to a device through which a stream of heated air under pressure can be emitted and directed. With such a device, it is also possible to control the air flow of the resultant jet of heated air. A conventional hot air knife is described in coassigned U.S. Pat. No. 5,707,468, issued Jan. 13, 1998 and U.S. Pat. No. 4,567,796 issued Feb. 04, 1986; both of which are hereby incorporated by reference in their entireties. A zoned hot air knife is described in U.S. application Ser. No. 08/877,377, the disclosure of which is incorporated by reference.

As used herein, the phrase "nonwoven web having zoned migration of internal additives" refers to a nonwoven web initially prepared from a substantially homogeneous blend of a polymer and an additive. The additives are caused to selectively migrate to regions or "zones" on the surface of the nonwoven web, so as to impart unique or enhanced properties only to those regions. The selected migration of an additive may occur at spaced apart locations on a given surface or surfaces of the nonwoven web, indicating zoning in the "X" and/or "Y" directions. Alternatively, the selected migration of an additive may occur on one surface of a nonwoven web, and not on an opposing surface (or to a lesser extent on an opposing surface), indicating zoning in the "Z" direction. The additive may be any internally blended liquid, semi-solid or solid additive which has a tendency to migrate to the polymer surface when sufficient heat is applied to the polymer.

DETAILED DESCRIPTION OF THE PRESENTLY PREFERRED EMBODIMENTS

The starting material for the invention is a nonwoven web including a plurality of filaments made from a blend of one or more polymers with an internal additive. The nonwoven web may be a spunbond web, a meltblown web, a bonded carded web, or another type of nonwoven web, and may be present in a single layer or a multilayer composite including one or more nonwoven web layers.

A wide variety of thermoplastic polymers may be used to construct the nonwoven web, including without limitation polyamides, polyesters, polyolefins, copolymers of ethylene and propylene, copolymers of ethylene or propylene with a $C_4$–$C_{20}$ alpha-olefin, terpolymers of ethylene with propylene and a $C_4$–$C_{20}$ alpha-olefin, ethylene vinyl acetate copolymers, propylene vinyl acetate copolymers, styrene-poly(ethylene-alpha-olefin) elastomers, polyurethanes, A-B block copolymers where A is formed of poly(vinyl arene) moieties such as polystyrene and B is an elastomeric mid-block such as a conjugated diene or lower alkene, polyethers, polyether esters, polyacrylates, ethylene alkyl acrylates, polyisobutylene, polybutadiene, isobutylene-isoprene copolymers, and combinations of any of the foregoing. Polyolefins are preferred. Polyethylene and polypropylene are most preferred. The webs may also be constructed of bicomponent or biconstituent filaments or fibers, as defined above. The nonwoven webs may have a wide variety of basis weights, preferably ranging from about 0.1 gram per square meter (gsm) to about 100 gsm.

The internal additive is a compound which migrates from the interior of a polymer filament to the surface upon the application of heat sufficient to at least partially soften or melt the polymer, followed by subsequent cooling. The additive may be a compound or blend capable of imparting any desirable property, including without limitation surfactants, repellents, stabilizers, colorants, and combinations thereof. In one embodiment, the additive may have at least two moieties, A and B, in which:

(A) moiety A and moiety B act as a single molecular unit which is compatible with said polymer at melt extrusion temperatures but is incompatible at temperatures below melt extrusion temperatures, but each of moiety A and moiety B, taken as separate molecular units, is incompatible with said polymer at melt extrusion temperatures and at temperatures below melt extrusion temperatures; and (B) moiety B has at least one functional group which imparts to said polymeric material at least one desired characteristic.

Because the additive is compatible with the polymer at melt extrusion temperatures, the additive is miscible with the polymer and the polymer and the additive form a metastable solution. The solution formed by the additive and the polymer at temperature above melt extrusion temperatures is referred to herein as a metastable solution since the solution is not stable at temperatures below melt extrusion temperatures. As the temperature of the newly formed fiber drops below melt extrusion temperatures, the polymer begins to solidify which contributes to additive separating from the polymer phase. At the same time, the additive becomes less compatible with the polymer. Both factors contribute to the rapid migration or segregation of additive toward the surface of the newly formed fiber which occurs in a controllable manner.

Additive surface segregation is influenced by the molecular weight of the additive. More specifically, the lower the molecular weight of the additive, the more rapid is the rate of segregation of the additive to the surface of the filament at any given temperature at which the filament still is in a sufficiently molten state. The additive can be monomeric, oligomeric, or polymeric.

The additive molecular weight should be in the range of from about 400 to about 10,000. This range encompasses suitable additive molecular weights, regardless of whether the additive is to be used by itself or in a mixture of additives; the additive molecular weight range depends in part on whether or not an additive will be used by itself.

The molecular weight range for additives which are to be used individually in compositions for filament formation and not as part of a mixture of additives typically is from about 400 to about 3,000. Preferably, this range is from about 500 to about 2,000, and more preferably from about 500 to about 1,500. The most preferred range is from about 500 to about 1,000.

When additives are intended to be used in a mixture, however, higher molecular weights can be employed. Although the reasons for this are not clearly understood, mixtures of additives frequently are more compatible with the polymer at melt-extrusion temperatures than are the individual additives. Although the selection of additive mixtures is somewhat empirical, in general such mixtures can utilize additives having molecular weights in the range of from about 400 to about 10,000 and preferably from about 400 to about 8,000.

It should be noted that the foregoing molecular weight ranges are based on the assumption that oligomeric or polymeric additives will have relatively broad polydispersities, e.g., of the order of about 1.2 and higher. While narrow polydispersities certainly are achievable, usually at a higher cost, they are not necessary, even if relatively low molecular weight additives are to be employed. As a guideline, it may be noted that for a given additive, the average molecular weight of an additive having a narrower polydispersity usually should be slightly lower than the average molecular weight of an additive having a broad polydispersity. While this guideline is not precise and is somewhat empirical in nature, one skilled in the art will be able to properly select an additive of any polydispersity without undue experimentation.

The term "additive" is used broadly herein to encompass the use of two or more additives in a given composition. Such two or more additives may have the same or similar moieties B, or different moieties B having the same characteristic, e.g., water wettability. On the other hand, two or more additives may be used which have different characteristics, which characteristics may be related or unrelated. Such two or more additives may be present in similar or significantly different amounts. Moreover, the additives may have the same or similar molecular weights in order to segregate in the filament to approximately the same region. Alternatively, different molecular weight additives may be employed in order to effectively layer the additives on the surface.

The use of different molecular weight additives is especially attractive for some characteristics which reinforce each other, an example of which is the use of a first additive having a moiety B which is an absorber of ultraviolet radiation and a second additive having a light stabilizing or degradation inhibiting moiety B which functions by deactivating excited oxygen molecules or terminating free radicals. The first additive normally will have a lower molecular weight than the second. While both additives segregate to the surface, the first additive migrates primarily to the effective surface, while the second additive migrates primarily to the subsurface. Thus, actinic radiation which is not absorbed by the first additive is effectively nullified by the second additive, resulting in a complementary or synergistic effect.

The internal additive can be a liquid or solid. In general, the weight ratio of the thermoplastic polymer to the internal additive is about 10 to 1000. That is, the amount of additive in the composition used to make the nonwoven web is about 0.1% by weight to about 10% by weight, preferably about 0.3–5% by weight, more preferably about 0.5–2.5% by weight.

The thermoplastic composition can be prepared by any number of methods known to those having ordinary skill in the art. For example, the polymer in powder, chip or pellet form and the additive in powder, chip or pellet form can be mixed mechanically. If desired, the additive can be dissolved in a suitable solvent and coated onto polymer particles by mechanically mixing the two, although the use of a solvent is not preferred. A liquid additive can also be coated onto polymer particles using this mixing process. The polymer and additive mixture then can be added to the feed hopper of the extruder from which the filaments will emerge. Alternatively, the coated polymer can be charged to a heated compounder, such as a heated twin-screw compounder, in order to disperse the additive throughout the bulk of the polymer. The resulting thermoplastic composition typically is extruded as rods which are fed to a chipper. The resulting chips then serve as the feed stock for a melt-processing extruder. In another method, the additive can be metered into the throat of the hopper which contains the polymer in particulate form and which feeds the extruder. In yet another method, the additive can be metered directly into the barrel of the extruder where it is blended with the molten polymer as the resulting mixture moves toward the die.

A wide variety of internal migrating additive types may be employed in the zoned nonwoven webs of the invention. Suitable additive types include without limitation solvent repellents, wetting agents and other surfactants, tackifiers and adhesives, flame retardants, antistatic agents, stabilizers to ultraviolet radiation, stabilizers to heat, colorants, inks, and other compounds which migrate to the surface when exposed to heat.

Suitable migrating additives include fluorochemicals, which are thermally stable at polymer melt extrusion temperatures, and which may act as repellents and flame retardants. Fluorinated hydrocarbons are typically more dense and volatile than the corresponding hydrocarbons, and have lower refractive indices, lower dielectric constants, lower solubilities and lower surface tensions than the corresponding non-fluorinated hydrocarbons. The presence of the fluorine atoms imparts stability, nonflammability, hydrophobicity, and oleophobic characteristics to the underlying molecules. Perfluorinated ($C_8F_{17}$—) molecules are believed to be the most effective.

Suitable internal fluorochemicals include without limitation ZONYL®8615 (a fluorinated melt additive available from E. I. DuPont DeNemours & Co.); FX-1801, a nonionic fluorochemical resin available from the 3M Company; TLF-8860, a fluorinated melt additive available from E. I. DuPont DeNemours & Co.; and ZONYL®9010, a fluorinated melt additive available from E. I. DuPont DeNemours & Co. Other suitable internal fluorochemical additives are disclosed and described in U.S. Pat. No. 5,459,188, issued to Sargent et al.; U.S. Pat. No. 5,681,963, issued to Liss; and U.S. Pat. No. 5,025,052, issued to Crater et al., the disclosures of which are incorporated herein by reference.

Internal silicone additives are also suitable as repellents and surfactants. Like fluorochemicals, silicones tend to be incompatible with polyolefins and certain other polymers, providing a driving force for the additives to separate from the matrix polymers in the presence of heat and migrate to the nearest surfaces. Suitable silicone-based additives are disclosed and described in U.S. Pat. No. 4,857,251, issued to Nohr et al., the disclosure of which is incorporated by reference. Preferred silicone-based additives include siloxane-containing additives having the moieties A and B, as described previously.

In some preferred embodiments, moiety A comprises at least one tetrasubstituted disiloxanylene group, optionally associated with one or more groups selected from the group consisting of trisubstituted silyl and trisubstituted siloxy groups, the substituents of all such groups being independently selected from the group consisting of monovalent alkyl, cycloalkyl, aryl, and heterocyclic groups, each of which may be substituted or unsubstituted, and moiety B.

In still other preferred embodiments, the additive contains a plurality of groups selected from the group represented by the following general formulae:

(1) $B_1$—, (2) $B_2$—O—, (3) $R_1$—, (4) $R_2$—Si≡, (5) $(R_3)(R_4)(R_5)$Si—, (6) $(R_6)(R_7)(R_8)$Si—O—, (7) [—Si$(R_9)(R_{10})$—O—]a, and (8) [—Si$(R_{11})(B_3)$—O—]b;

in which each of $R_1$ and $R_2$ independently is a monovalent group selected from the group consisting of hydrogen, alkyl, cycloalkyl, aryl, and heterocyclic groups, each of which, except for hydrogen, may be substituted or unsubstituted; each of $R_3$–$R_5$, inclusive, independently is a monovalent group selected from the group consisting of alkyl, cycloalkyl, aryl, and heterocyclic groups, each of which may be substituted or unsubstituted, and $B_4$; each of $R_6$–$R_{11}$, inclusive, independently is a monovalent group selected from the group consisting of alkyl, cycloalkyl, aryl, and heterocyclic groups, each of which may be substituted or unsubstituted; each of a and b independently represents an integer from 0 to about 70 which indicates only the quantity of the respective group present in the additive without indicating or requiring, in instances when an integer is greater than 1, that such plurality of the respective group are connected to one another to form an oligomer or polymer or that all of such groups have identical substituents; and each of $B_1$—$B_4$, inclusive, independently is a moiety which imparts to the additive at least one desired characteristic; with the proviso that such plurality of groups results in at least one tetrasubstituted disiloxanylene group.

In still other preferred embodiments, the additive is a compound having the general formula,

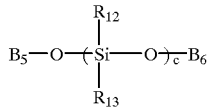

in which each of $R_{12}$ and $R_{13}$ independently is a monovalent group selected from the group consisting of hydrogen, alkyl, cycloalkyl, aryl, and heterocyclic groups, each of which, except for hydrogen, may be substituted or unsubstituted; each of $B_5$ and $B_6$ independently is a monovalent group having a desired characteristic; and c represents an integer from 2 to about 70.

In yet other preferred embodiments, the additive is a compound having the general formula,

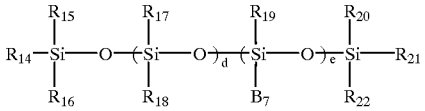

in which each of $R_{14}$–$R_{22}$, inclusive, independently is a monovalent group selected from the group consisting of hydrogen, alkyl, cycloalkyl, aryl, and heterocyclic groups, each of which, except for hydrogen, may be substituted or unsubstituted; $B_7$ is a monovalent group having a desired characteristic; d represents an integer from 0 to about 70; and e represents an integer from 1 to about 70.

In yet other preferred embodiments, the additive is a compound having the general formula,

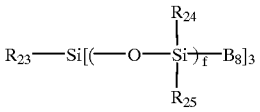

in which each of $R_{23}$–$R_{25}$, inclusive, independently is a monovalent group selected from the group consisting of hydrogen, alkyl, cycloalkyl, aryl, and heterocyclic groups, each of which, except for hydrogen, may be substituted or unsubstituted; $B_8$ is a monovalent group having a desired characteristic; and f represents an integer from 1 to about 70.

In accordance with the invention, the polymeric nonwoven web containing the migrating additive is selectively heated in zones, to cause selective migration of the internal additive to the surface, resulting in desired surface properties occurring in the zones. The additive may be caused to migrate to the surface only in one or more selected spaced-apart zones. Alternatively, the additive may be caused to migrate to the surface to a greater extent in the selected zone and to a lesser extent in a region not in the selected zone. The selected zone, and the region not in the selected zone, may be on the same or opposite sides of the nonwoven web, or may both be on two sides. One preferred way of causing the selective heating is through the use of a zoned hot air knife as described in U.S. patent application Ser. No. 08/877,377, to Marmon et al., filed Jun. 14, 1998, the disclosure of which is incorporated by reference.

FIG. 1 shows an exemplary hot air knife in cross-section. Hot air is supplied from a plenum 1 through a slot 2 onto a nonwoven web (not shown). In a zoned hot air knife arrangement which includes a plurality of spaced apart hot air knives, the length of each slot 2 (i.e., in a direction perpendicular to the paper) will be about as great as each of the corresponding spaced-apart zones being treated.

Figure 2:
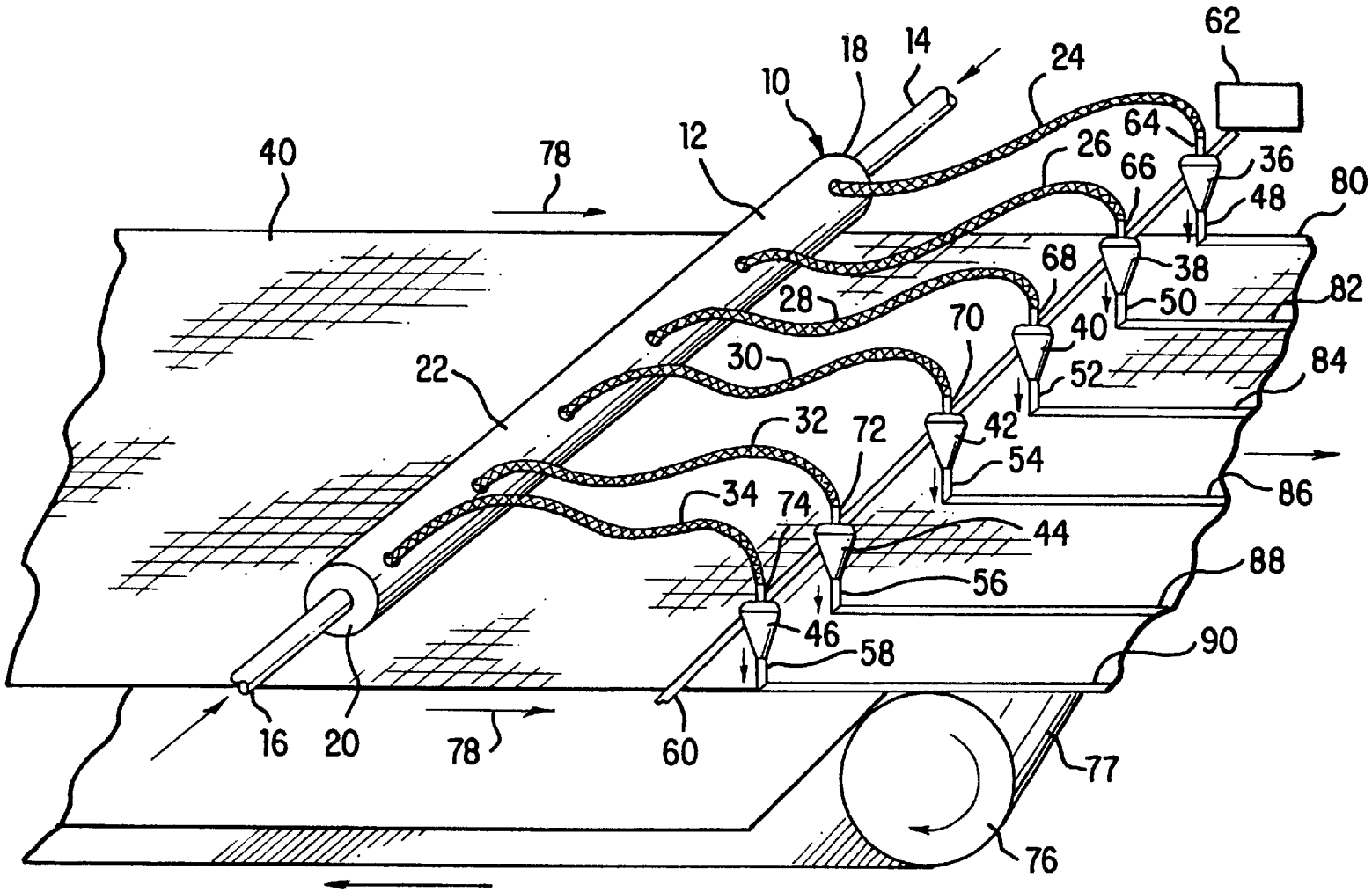
FIG. 2 is a perspective view of a process for causing selected (regional) migration of additives in a nonwoven web, using a zoned hot air knife assembly.

FIG. 2 illustrates a hot air knife assembly 10, including a header 12 which is supplied with hot air through the inlet channels 14 and 16. The header 12 is shaped like an elongated hollow cylinder having ends 18 and 20 and a main body 22. The hot air supply channels 14 and 16 feed air into the ends 18 and 20 of the header 12, as shown by the arrows.

The hot air supplied to the header 12 may have a temperature of about 150–500° F., more generally about 200–450° F., most commonly about 250–350° F. The optimum temperature will vary according to the polymer type, basis weight and line speed of the nonwoven web 40 traveling beneath the hot air knife assembly 10. For a polypropylene nonwoven web having a basis weight of about 0.5–1.5 osy, and traveling at a line speed of about 1000–1500 feet per minute, a hot air temperature of about 250–325° F. is desirable. Generally, the hot air temperature should be at or near (e.g., slightly below) the melting temperature of the nonwoven web.

The preferred volumetric flow of hot air being fed to each hot air knife from the header 12 is generally dependent on the composition and weight of the web, the line speed, and the degree of additive migration required. The air flow rate may be controlled by controlling the pressure inside the header 12. The air pressure inside the header 12 is preferably between about 1–12 inches of water (2–22 mm Hg), more preferably between about 4–10 inches of water (8–18 mm Hg). Of course, the volume of hot air required to effect the desired level of additive migration may be reduced by increasing the temperature of the hot air. Operating parameters such as line speed, hot air volume, and hot air temperature can be determined and adjusted using techniques known and/or available to persons of ordinary skill in the art.

In the embodiment shown in FIG. 2, the header 12 is cylindrical, but it can be rectangular or of another shape. Numerous sizes and shapes can be employed for the header 12, with the preferred size depending largely on the width of the nonwoven web and the degree of bonding required. The header 12 can be constructed from aluminum, stainless steel, or another suitable material.

Extending from the header 12 are six spaced apart hot air conduits 24, 26, 28, 30, 32 and 34. The conduits may be rigid or flexible, but are preferably made of a flexible material in order to permit adjustment and/or movement. The conduits are each connected at one end to the header 12, and are connected at their other ends to six plenums 36, 38, 40, 42, 44 and 46. Each plenum engages a hot air knife slot, with the slots being labeled 48, 50, 52, 54, 56 and 58. The plenums and slots shown in FIG. 2 may each have a cross-section similar to that shown in FIG. 1, and described above.

Hot air from the header 12 is preferably supplied at roughly equal volume and velocity to each of the conduits 24, 26, 28, 30, 32 and 34. This equal division of flow can be accomplished in simple fashion, by ensuring that the conduits are of equal dimensions and size and that the air pressure is uniform at the entrances to the conduits. On the other hand, if a particular application warrants feeding more or less air into some of the conduits than the others, different flow rates can be accomplished by individually valving the conduits, by designing them with different sizes, or by valving the plenums as explained below.

The plenums 36, 38,40,42,44 and 46 are mounted to a slidable support bar 60. The plenums are mounted so that the lower tips of the air knife slots 48, 50, 52, 54, 56 and 58 are at a predetermined distance above the nonwoven web 40. The distance between the air knife slots and the nonwoven web should be about 0.25 to about 10 inches, preferably about 0.75 to about 3.0 inches, most preferably about 1.0 to about 2.0 inches. Preferably, the plenums are adjustably mounted to the support bar 60 so that the distance between the knife slots and the web can be varied according to the needs of the application.

A control panel 62 is provided on one side of the hot air knife assembly 10, incorporating individual flow controls for hot air entering the plenums. As shown, the plenums are provided with individual flow control valves 64, 66, 68, 70, 72 and 74 which can be used to individually adjust the air flow to each plenum. The flow control valves may be electronically linked to individual controls at the control panel 62 using conventional techniques available to persons skilled in the art. As explained above, it is often desirable to have roughly equal air flow to each of the plenums. The valves can be used for fine tuning and equalizing the air flows to the plenums, or for differentiating between them if different flows are desired.

The nonwoven web 40 is carried on an endless belt conveyor including a carrying screen 77 driven by rollers (one of them at 76) at a predetermined line speed. The nonwoven web 40 travels in the machine direction (indicated by arrow 78) underneath the hot air knife assembly 10, at a speed of generally about 100–3000 feet per minute, more commonly about 500–2500 feet per minute, desirably about 1000–2000 feet per minute. The hot air knife slots 48, 50, 52, 54, 56 and 58 apply jets of hot air into the nonwoven web, causing localized additive migration to occur, at spaced apart locations. The spaced apart zones of hot air knife-enhanced additive migration are represented by areas 80, 82, 84, 86, 88 and 90. In the embodiment shown, the zones of additive migration are linear. In another embodiment, the support bar 60 is in communication with an oscillator (not shown) which causes the support bar 60 to move back and forth in the transverse direction (i.e., perpendicular to the machine direction) as the nonwoven web 40 is carried forward in the machine direction. By using an oscillator, the zones of enhanced additive migration 80, 82, 84, 86, 88 and 90 can be formed in a wavelike pattern including without limitation sine waves, triangular waves, square waves, trapezoidal waves, or irregular waves.

The thicknesses of the zones 80, 82, 84, 86, 88 and 90 correspond to the lengths of the air knife slots 48, 50, 52, 54, 56 and 58. The zones may be as wide or narrow as necessary, to minimize the energy requirements while providing adequate regions of enhanced properties. The air knife slots may each have a length less than about 1.0 inch, preferably less than about 0.5 inch, more preferably about 0.10–0.25 inch. The length of the air knife slots will correspond substantially to the width of the regions of additive migration in the web 40. The lengths of the air knife slots (i.e., perpendicular to the movement of the web) may be determined based on the overall percentage of additive migration area desired.

The width of the openings in the hot air knife slots 48, 50, 52, 54, 56 and 58 (i.e., the width of the opening as shown in FIG. 1) should be configured to give the desired velocity of air jets hitting the surface of the web 40. The actual velocity of the airjets is determined by the air pressure inside the header 12, the total number of air knife slots, the lengths of the air knife slots, and the widths of the hot air knife slots. The desired air jet velocity from the air knife slots is whatever velocity is required to cause adequate additive migration to the surfaces of the nonwoven web filaments. Generally, the width of each air knife slot opening (i.e., parallel to the direction of movement of the web) should be about 0.5 inch or less.

The number of spaced apart air knife plenums and slots may vary according to the width of the nonwoven web being treated, and the lengths of the individual air knife slots. The larger the number of plenums and slots is, the greater the maximum width of the web is that can be effectively treated. Generally, the hot air knife assembly 10 should include at least two spaced apart air knife plenums and slots, when the nonwoven web 40 has a width of about 14–16 inches. Nonwoven webs may have widths up to 140 inches or higher, and the desired number and/or size of air knife plenums may increase with the width of the nonwoven web. As explained above, the air knife assembly 10 shown in FIG. 2 includes six spaced apart air knife plenums and slots. The air knife plenums may be spaced from about 1–24 inches apart, but are preferably spaced from about 4–20 inches apart, more preferably from about 10–15 inches apart. Alternatively, the same effect may be created by providing a single slot opening extending across the width of the header 12, and blocking off parts of the slot opening to create one or more individual slot openings between the blocked off regions.

The hot air knife assembly 10 of the invention makes it possible to produce nonwoven webs with limited additive migration from the filaments, and correspondingly less overall surface migration than nonwoven webs which are treated in their entireties. The hot air knife assembly 10 is especially useful to effect limited migration of additives from meltblown webs as shown in FIG. 2.

The selective additive migration is effected as the nonwoven web 40 (FIG. 2) moves underneath the hot air knife and is contacted with one or more jets of hot air, preferably within about 15 degrees of perpendicular to the web. As a consequence of the thermal energy imparted by the combination of temperature, pressure, and turbulent flow rates of the one or more air jets, the nonwoven web filaments are heated in the regions or zones below the hot air knives, to cause selective additive migration and desired properties in the regions 80, 82, 84, 86, 88 and 90 shown in FIG. 2.

Other methods and devices may also be employed to create selected regions or zones of additive migration in a nonwoven web. For instance, the web may be selectively heat treated using infrared radiation, induction heat, or other methods. Also, techniques of the invention may be employed to cause zoned migration of additives in the "Z" direction, as well as in the "X" and "Y" directions as described above. To achieve zoned migration in the "Z" direction, a heat source can be aimed at one surface of a nonwoven fabric in such fashion that the one surface is heated to a far greater extent than the opposite surface. For example, a heat source, such as a hot air jet, may be aimed at one surface of the nonwoven web at a low angle which is almost parallel to the one surface. This will cause most of the convective heat transfer, and additive migration, to occur on one surface as opposed to the other.

EXAMPLES

Fabrics 1–9

Melt blown nonwoven webs having internal fluorocarbon additives were prepared from substantially homogeneous blends of polymer and internal additives. The resulting webs were selectively heat treated to cause zoned migration of the additives, and were tested for alcohol repellency. The polymer component of each fabric contained about 90% by weight polypropylene blended with 10% by weight polybutylene. The following polymers and additives were used in the nonwoven web samples.

Internal fluorochemical (IFC):

a) 3M FX-1801, a nonionic fluorochemical resin, b) DuPont ZONYL®8615, a fluorinated melt additive, c) DuPont TLF-8860, a fluorinated melt additive, or d) DuPont ZONYL®9010, a fluorinated melt additive.

Polypropylene (PP):

a) Exxon 3746G, an 800 MFR resin, or b) Montell PF-015, a 400 MFR resin.

Polybutylene (PB):

Shell DP-8911, a 5.5% ethylene, 94.5% 1-butene copolymer.

The repellency of the finished nonwoven fabrics to isopropyl alcohol (IPA) was tested by placing drops of IPA/water solutions on the fabric surface. The solutions contained from 20–100% by volume IPA in water, varied in increments of 10%. As the level of IPA in the solution is increased, the solution surface tension decreases. Therefore, solutions with high levels of IPA are more difficult to repel. As a reference point, 100% IPA has a surface tension of about 22 dynes/cm.

To perform the test, eight drops of each IPA/water solution were placed along the cross machine direction of the meltblown fabric being tested. After five minutes, a repellency rating was given. The repellency rating was the solution with the highest percentage IPA that did not wet the fabric surface. The back of each fabric was observed to determine if the fabric was wetted by the IPA solution. If one or more of the eight drops of an IPA solution wetted the fabric, then the fabric was failed at that level.

In some cases, a rating between increments of 10% IPA was given. For instance, a rating of 85% IPA indicates that the fabric easily repelled 80% IPA but only a drop or two of 90% IPA just slightly wetted the fabric. For control purposes, it was determined that the meltblown fabric without any IFC treatment passes only 20% IPA.

The compositions and fabrics were prepared as follows:

Fabric No. 1

2.75 pounds of SCC-4983 (a compounded masterbatch of 15% FX-1801 IFC/85% 3746G PP), 4 pounds of DP-8911 PB, 34 pounds of 3746G PP, and 0.75 pound of SCC-11115 blue pigment were dry tumbled in a mixer for at least 30 minutes, and then added to the extruder and processed into meltblown fabric having a basis weight of 0.5 osy. This composition gives a target level of 1.0% FX-1801 IFC, 9.6% PB, 87.6% PP, and 1.8% pigment in the meltblown fabric.

Fabric No. 2

0.41 pound of TLF-8860, 4 pounds of DP-8911 PB, 36 pounds of 3746G PP, and 0.8 pound of SCC-11115 blue pigment were dry tumbled in a mixer for at least 30 minutes, and then added to the meltblown extruder and blown into fabric having a basis weight of 0.5 osy. This composition gives a target level of 1.0% TLF-8860 IFC, 9.7% PB, 87.4% PP, and 1.9% pigment.

Fabric No. 3

0.44 pound of ZONYL®8615, 4 pounds of DP-8911 PB, 36 pounds of 3746G PP, and 0.8 pound of SCC-11115 blue pigment were dry tumbled in a mixer for at least 30 minutes, and then added to the meltblown extruder and blown into fabric having a basis weight of 0.5 osy. This composition gives a target level of 1.1% ZONYL®8615 IFC, 9.7% PB, 87.3% PP, and 1.9% pigment.

Fabric No. 4

0.41 pound of ZONYL®8615, 4 pounds of DP-8911 PB, 36 pounds of 3746G PP, and 0.75 pound of SCC-11115 blue pigment were dry tumbled in a mixer for at least 30 minutes, and then added to the meltblown extruder and blown into fabric having a basis weight of 0.5 osy. This composition gives a target level of 1.0% ZONYL®8615 IFC, 9.7% PB, 87.5% PP, and 1.8% pigment.

Fabric No. 5

0.54 pound of ZONYL®8615, 4 pounds of DP-8911 PB, 36 pounds of 3746G PP, and 0.75 pound of SCC-11115 blue pigment were dry tumbled in a mixer for at least 30 minutes, and then added to the meltblown extruder and blown into fabric having a basis weight of 0.5 osy. This composition gives a target level of 1.3% ZONYL®8615 IFC, 9.7% PB, 87.2% PP, and 1.8% pigment.

Fabric No. 6

0.41 pound of ZONYL®9010, 4 pounds of DP-8911 PB, 36 pounds of 3746G PP, and 0.75 pound of SCC-11115 blue pigment were dry tumbled in a mixer for at least 30 minutes, and then added to the meltblown extruder and blown into fabric having a basis weight of 0.5 osy. This composition gives a target level of 1.0% ZONYL®9010 IFC, 9.7% PB, 87.5% PP, and 1.8% pigment.

Fabric Nos. 7–9

0.83 pound of ZONYL®8615, 8 pounds of DP-8911 PB, 72 pounds of 3746G PP, and 1.5 pounds of SCC-11115 blue pigment were dry tumbled in a mixer for at least 30 minutes, and then added to the meltblown extruder and blown into fabric having a basis weight of 0.5 osy. This composition gives a target level of 1.0% ZONYL®8615 IFC, 9.7% PB, 87.5% PP, and 1.8% pigment. Three rolls of fabric were made with this composition.

Each of Fabrics 1–9 had a web width of about 18–20 inches. To create a zoned effect, each fabric was treated using a single hot air knife, approximately centered across the web, having a long dimension of about 12 inches perpendicular to the machine direction of the web. This created a center zone of selectively heat treated fabric, and two side zones of untreated fabric.

The following Table 1 shows the process conditions and effect of the hotair knife (HAK) on the repellency of Fabric No. 1. The hot air knife was mounted outside the meltblown forming box, 25 inches from the center of the roll winder, and about 1 inch above the fabric. The repellency ratings were taken in the HAK-treated zone for the treated sample, and compare the repellency effect of HAK versus no HAK.

TABLE 1

Repellency Ratings For Fabric No. 1

| MT (Melt Blowing Temp, ° F.) | PAT (Primary Air Temp, ° F.) | PAFS (Primary Air Flow Setting, psi.) | UWV (Under-Wire Vacuum, % of max. output) | HAK Conditions | Repellency (% IPA) |
|---|---|---|---|---|---|
| 540 | 530 | 3.1 | 30.2 | Off | 55 |
| 540 | 535 | 2.3 | 30.2 | 305° F., 18 psi | 80 |

The following Table 2 compares the effect of different process conditions and the effect of the HAK on Fabric No. 2. This time, the HAK was mounted inside the forming box, about 2 inches from the curtain of meltblown fibers. The UWV was increased to remove the extra air from the HAK. For the HAK-treated sample repellency was measured in the HAK-treated region unless otherwise noted.

TABLE 2

Repellency Ratings For Fabric No. 2

| MT (Melt Blowing Temp, ° F.) | PAT (Primary Air Temp, ° F.) | PAFS (Primary Air Flow Setting, psi.) | UWV (Under-Wire Vacuum, % of max. output) | HAK Conditions | Repellency (% IPA) | Repellency After 4 Days (% IPA) |
|---|---|---|---|---|---|---|
| 540 | 550 | 0.8 | 30.2 | Off | 45 | 45 |
| 540 | 550 | 0.7 | 12.0 | Off | 40 | 55 |
| 540 | 555 | 1.1 | 45.0 | Off | 45–50 | 60 |
| 540 | 555 | 1.1 | 45.0 | 253° F., 18 psi | 45–50 | 60 |
| | | | | | | 55 (region of no HAK exposure) |

The following Table 3 compares the effect of different process conditions and the HAK on Fabric No. 3. The HAK was mounted in the meltblown forming box, about 2 inches from the curtain of meltblown fibers. Again, the UWV had to be increased to remove the extra air from the HAK. For the HAK-treated sample, repellency was measured in the HAK-exposed region unless otherwise noted.

TABLE 3

Repellency Ratings For Fabric No. 3

| MT (Melt Blowing Temp, ° F.) | PAT (Primary Air Temp, ° F.) | PAFS (Primary Air Flow Setting, psi.) | UWV (Under-Wire Vacuum, % of max. output) | HAK Conditions | Repellency (% IPA) | Repellency After 4 Days (% IPA) |
|---|---|---|---|---|---|---|
| 540 | 550 | 1.0 | 30.2 | Off | 35 | 65 |
| 540 | 550 | 1.0 | 12.0 | Off | 80 | 90 |
| 540 | 550 | 1.0 | 45.0 | 310° F., 18 psi | 75 | 85 |
| | | | | | 55 (region of no HAK) | 75 (region of no HAK) |

The following Table 4 compares the effect of different additive levels and the HAK using Fabric Nos. 4 and 5. The HAK was mounted outside the meltblown forming box, 25 inches from the center of the roll winder, and about 1 inch above the fabric. Again, the repellency was measured in the HAK-treated region when the HAK was on.

TABLE 4

Repellency Ratings For Fabric Nos. 4 and 5

| Fabric No. | % Additive | MT | PAT | PAFS | UWV | HAK Conditions | Repellency (% IPA) |
|---|---|---|---|---|---|---|---|
| 4 | 1.0 | 540 | 535 | 3.0 | 30.2 | Off | 40 |
| 4 | 1.0 | 540 | 535 | 2.1 | 30.2 | 300° F., 18 psi | 90 |
| 5 | 1.3 | 540 | 535 | 3.1 | 30.2 | Off | 70 |
| 5 | 1.3 | 540 | 535 | 2.6 | 30.2 | 300° F., 18 psi | 95 |

The following Table 5 compares the effect of different process conditions and the HAK on Fabric No. 6. The HAK was mounted outside the meltblown forming box, 25 inches from the center of the roll winder, and about 1 inch above the fabric. Again, the repellency was measured in the HAK-treated region when the HAK was on.

TABLE 5

Repellency Ratings For Fabric No. 6

| MT (Melt Blowing Temp, ° F.) | PAT (Primary Air Temp, ° F.) | PAFS (Primary Air Flow Setting, psi.) | UWV (Under-Wire Vacuum, % of max. output) | HAK Conditions | Repellency (% IPA) |
|---|---|---|---|---|---|
| 540 | 530 | 4.5 | 30.2 | Off | 80 |
| 540 | 530 | 3.1 | 30.2 | Off | 70 |
| 540 | 535 | 3.5 | 30.2 | 300° F., 18 psi | 85 |

For Fabric Nos. 7–9, the fabric temperature was monitored. Fabric No. 7 run without the HAK. Fabric No. 8 was run with the HAK, resulting in a higher fabric temperature. Fabric No. 9 was run with the HAK being vented to remove some of the additional heat. To vent the HAK, the pipe that feeds the HAK was vented above and away from the meltblown die tip.

The HAK was mounted 25 inches from the roll winder and positioned 1.5 inches above the forming wire. This causes a curtain of air to impinge on the fabric just before the winder. When the HAK was vented, the HAK increased the room air temperature without causing a curtain of air to impinge on the fabric.

TABLE 6

Repellency Ratings For Fabric Nos.7–9

| Fabric No. | MT | PAT | PAFS | UWV | HAK Conditions | Fabric Temp., ° F. | Repellency (% IPA) |
|---|---|---|---|---|---|---|---|
| 7 | 540 | 550 | 1.9 | 30.2 | Off | 93–104 | 30 |
| 8 | 540 | 550 | 1.4 | 30.2 | 295° F., 22 psi | 135–145 | 80 |
| 9 | 540 | 550 | 1.4 | 30.2 | 295° F., 22 psi, vented | 110–115 | 30 |

EXAMPLES

Fabrics 10–14

Meltblown nonwoven webs similar to Fabrics 1–9 were prepared, except that internal wetting agents were used instead of repellents. Two internal wettable treatments were evaluated:

a) SF-19, a polysiloxane polyether from PPG Industries, introduced as a 12% masterbatch in polypropylene; and b) Atmer 8041, a surfactant from ICI Surfactants of Delaware, identified only as a "20% Super Concentrate".

The following Fabrics 10–14 were produced and tested for wettability using static drops of water.

Fabric No. 10

1.67 pounds of the 12% SF-19 masterbatch was dry tumbled with 38.5 pounds of PF-015 PP for at least 30 minutes. The mixture was then put into the extruder and 0.5 osy meltblown fabric was made. The target composition of the fabric was therefore 0.5% SF-19 and 99.5% PP. The process conditions were melt temperature=520° F., PAT=505° F., PAFS=5.5, underwire vacuum=30.2%, extruder pressure=1000 psi, and throughput=2 pounds per inch per hour (PIH). The treated fabric was not wettable to static drops of water.

A roll of fabric with the above composition was then exposed to a hot air knife (HAK). The other process conditions were the same as described for the above fabric. The HAK was mounted about 25 inches from the roll winder and was positioned about 1–1.5 inches above the forming wire. The HAK conditions were 290° F. and 20 psi. This fabric was also not wettable to static drops of water.

Fabric No. 11

1.67 pounds of the 12% SF-19 masterbatch was dry tumbled with 4 pounds of DP-8911 PB and 34.5 pounds of PF-015 PP for at least 30 minutes. The mixture was then put into the extruder and 0.5 osy meltblown fabric was made. The target composition of the fabric was therefore 0.5% SF-19, 10.0% PB, and 89.5% PP. The process conditions were melt temperature=520° F., PAT=505° F., PAFS=5.5, underwire vacuum=30.2%, extruder pressure=1000 psi, and throughput=2 PIR. The treated fabric was not wettable to static drops of water.

A roll of fabric with the above composition was then exposed to a hot air knife (HAK). The other process conditions were the same as described for the above fabric. The HAK was mounted about 25 inches from the roll winder and was positioned about 1–1.5 inches above the forming wire. The HAK conditions were 290° F. and 20 psi. This fabric was also not wettable to static drops of water.

Fabric No. 12

5 pounds of the 12% SF-19 masterbatch was dry tumbled with 37 pounds of PF-015 PP for at least 30 minutes. The mixture was then put into the extruder and 0.5 osy meltblown fabric was made. The target composition of the fabric was therefore 1.4% SF-19 and 98.6% PP. The process conditions were melt temperature=520° F., PAT=515° F., PAFS=5.1, underwire vacuum=30.2%, extruder pressure=1000 psi, and throughput=2 PIH. The treated fabric was not wettable to static drops of water.

A roll of fabric with the above composition was then exposed to a hot air knife (HAK). The process conditions were melt temperature=520° F., PAT=510° F, PAFS=5.0, underwire vacuum=30.2%, extruder pressure=1000 psi, and throughput=2 PIH. The HAK was mounted about 25 inches from the roll winder and was positioned about 1–1.5 inches above the forming wire. The HAK conditions were 340° F. and 20 psi. This fabric was slightly wettable to static drops of water. The wetting was described as slow and nonuniform, but the fabric did wick water vertically.

Fabric No. 13

2 pounds of the 20% super concentrate of Atmer 8041 was dry tumbled with 39.25 pounds of PF-015 PP for at least 30 minutes. The mixture was then put into the extruder and 0.5 osy meltblown fabric was made. The target composition of the fabric was therefore 1.0% Atner and 99.0% PP. The process conditions were melt temperature=520° F., PAT=505° F., PAFS=5.0, underwire vacuum=30.2%, extruder pressure=1000 psi, and throughput=2 PIH. The treated fabric was not wettable to static drops of water.

A roll of fabric with the above composition was then exposed to a hot air knife (HAK). The process conditions were melt temperature=520° F., PAT=505° F., PAFS=5.5, underwire vacuum=30.2%, extruder pressure=1000 psi, and throughput=2 PIH. The HAK was mounted about 25 inches from the roll winder and was positioned about 1–1.5 inches above the forming wire. The HAK conditions were 290° F. and 20 psi. This fabric was also not wettable to static drops of water.

Fabric No. 14

2 pounds of the 20% super concentrate of Atmer 8041 was dry tumbled with 4 pounds of DP-8911 PB and 35.25 pounds of PF-015 PP for at least 30 minutes. The mixture was then put into the extruder and 0.5 osy meltblown fabric was made. The target composition of the fabric was therefore 1.0% Atmer, 9.7% PB, and 89.3% PP. The process conditions were melt temperature=520° F., PAT=505° F., PAFS=5.1, underwire vacuum=30.2%, extruder pressure=1000 psi, and throughput=2 PIH. The treated fabric was not wettable to static drops of water.

A roll of fabric with the above composition was then exposed to a hot air knife (HAK). The other process conditions were the same as described for the above fabric. The HAK was mounted about 25 inches from the roll winder and was positioned about 1–1.5 inches above the forming wire. The HAK conditions were 290° F. and 20 psi. This fabric was also not wettable to static drops of water.

The selectively zoned nonwoven fabrics of the invention have a wide variety of potential uses. In one application, the edges of a diaper cover can be made more water-repellent than the center, thereby directing fluid toward the center (and into the absorbent core), and away from the edges which contact the wearer. Other nonwoven fabric applications would also benefit from controlled fluid flow, in which fluid is directed away from certain locations and toward other locations. The bottom of a fabric can be made more wettable than the top, or vice versa, thereby urging fluid which contacts the fabric toward one side of the fabric, and away from the other side.

While the embodiments of the invention described herein are presently considered preferred, various modifications and improvements can be made without departing from the spirit and scope of the invention. The scope of the invention is indicated by the appended claims, and all changes that fall within the meaning and range of equivalency are intended to be embraced therein.

We claim:

1. A nonwoven fabric having one or more selectively zoned regions of additives arranged in stripes on an outer surface, and one or more areas laterally adjacent to the stripes not in the selectively zoned regions, comprising:

a plurality of nonwoven filaments made from a blend including one or more polymers and a migrating internal additive;

wherein the internal additive has migrated to the surface to a greater extent in the selectively zoned regions than in the areas not in the selectively zoned regions.

2. The nonwoven fabric of claim 1, wherein the internal additive is present at the surface only in the selectively zoned regions.

3. The nonwoven fabric of claim 1, wherein the internal additive is present at the surface to a greater extent in the selectively zoned regions, and to a lesser extent in the areas not in the selectively zoned regions.

4. The nonwoven fabric of claim 1, wherein the selectively zoned regions, and the areas not in the selectively zoned regions, are on one side of the nonwoven web.

5. The nonwoven fabric of claim 1, wherein the selectively zoned regions, and the areas not in the selectively zoned regions, are on opposite sides of the nonwoven web.

6. The nonwoven fabric of claim 1, wherein the selectively zoned regions, and the areas not in the selectively zoned regions, are both present on two sides of the nonwoven web.

7. The nonwoven fabric of claim 1, comprising a spunbonded web.

8. The nonwoven fabric of claim 1, comprising a meltblown web.

9. The nonwoven fabric of claim 1, comprising a bonded carded web.

10. The nonwoven fabric of claim 1, wherein the polymer in the nonwoven filaments comprises a material selected from polyolefins, polyamides, polyesters, copolymers of ethylene and propylene, copolymers of ethylene or propylene with a $C_4$–$C_{20}$ alpha-olefin, terpolymers of ethylene with propylene and a $C_4$–$C_{20}$ alpha-olefin, ethylene vinyl acetate copolymers, propylene vinyl acetate copolymers, styrene-poly(ethylene-alpha-olefin) elastomers, polyurethanes, A-B block copolymers where A is formed of poly(vinyl arene) moieties such as polystyrene and B is an elastomeric midblock such as a conjugated diene or lower alkene, polyethers, polyether esters, polyacrylates, ethylene alkyl acrylates, polybutylene, polybutadiene, isobutylene-isoprene copolymers, and combinations thereof.

11. The nonwoven fabric of claim 10, wherein the polymer comprises a polyolefin.

12. The nonwoven fabric of claim 11, wherein the polyolefin comprises polyethylene.

13. The nonwoven fabric of claim 11, wherein the polyolefin comprises polypropylene.

14. The nonwoven fabric of claim 13, further comprising polybutylene.

15. The nonwoven fabric of claim 1, wherein the migrating additive comprises a material selected from repellents, wetting agents, tackifiers, adhesives, flame retardants, antistatic agents, stabilizers, colorants, inks, and combinations thereof.

16. The nonwoven fabric of claim 1, wherein the migrating additive comprises a fluorochemical.

17. The nonwoven fabric of claim 16, wherein the fluorochemical comprises a material selected from nonionic fluorochemical resins, fluorinated melt additives, and combinations thereof.

18. The nonwoven fabric of claim 1, wherein the migrating additive comprises a silicone compound.

19. A nonwoven fabric prepared from a substantially homogeneous blend including a polymer and an internal additive having a tendency to migrate to a surface of the nonwoven web when exposed to heat, the nonwoven web comprising:

a plurality of nonwoven filaments made from the substantially uniform blend of polymer and internal additive;

one or more zones on the nonwoven web which have been selectively exposed to heat to cause selective migration of the internal additive to the surface; and one or more zones on the nonwoven web laterally adjacent to, and having less internal additive at the surface than the one or more zones selectively exposed to heat.

20. The nonwoven fabric of claim 19, wherein the substantially homogeneous blend comprises about 0.1–10% by weight of the internal additive.

21. The nonwoven fabric of claim 19, wherein the substantially homogeneous blend comprises about 0.3–5% by weight of the internal additive.

22. The nonwoven fabric of claim 19, wherein the substantially homogeneous blend comprises about 0.5–2.5% by weight of the internal additive.

23. The nonwoven fabric of claim 19, wherein the polymer comprises a polyolefin.

24. The nonwoven fabric of claim 19, wherein the polymer comprises a blend of polypropylene and polybutylene.

25. The nonwoven fabric of claim 19, wherein the internal additive comprises a fluorochemical.

26. The nonwoven fabric of claim 23, wherein the internal additive comprises a fluorochemical.

27. The nonwoven fabric of claim 19, wherein the internal additive comprises a silicone compound.

28. The nonwoven fabric of claim 23, wherein the internal additive comprises a silicone compound.

* * * * *